United States Patent [19]

Spooner

[11] Patent Number: 4,980,528

[45] Date of Patent: Dec. 25, 1990

[54] ARC INTERRUPTER

[75] Inventor: James Spooner, High Barnes, Sunderland, England

[73] Assignee: Northern Engineering Industries PLC, Newcastle Upon Tyne, England

[21] Appl. No.: 263,629

[22] Filed: Oct. 27, 1988

[30] Foreign Application Priority Data

Oct. 31, 1987 [GB] United Kingdom ..... 8725582

[51] Int. Cl.[5] ..... H01H 33/18

[52] U.S. Cl. ..... 200/147 R; 200/147 R

[58] Field of Search ..... 200/147 C, 147 R

[56] References Cited

U.S. PATENT DOCUMENTS 2,150,564 3/1939 Rowe ..... 200/147 R
2,820,122 1/1958 Teszner ..... 200/147 R

FOREIGN PATENT DOCUMENTS 478890 1/1938 United Kingdom .
2038100 7/1980 United Kingdom .
2082391 3/1982 United Kingdom .
2119573A 11/1983 United Kingdom .
2178239 7/1985 United Kingdom .
2188486 3/1986 United Kingdom .
2188487 3/1986 United Kingdom .
2188488 3/1986 United Kingdom .

*Primary Examiner*—Robert S. Macon
*Attorney, Agent, or Firm*—Rosen, Dainow & Jacobs

[57] ABSTRACT

In an arc interrupter fixed and movable contacts provide an openable current path. When the path between the contacts is opened an arc is generated between one of the contacts or a surface electrically continuous therewith providing an inner first arcing surface, and an electrode providing an outer second arcuate surface. The opening and closing of the current path is achieved by angular movement of the movable contact about an axis offset from the fixed contact. At least in the break position, the electrode surrounds and is separated by an annular gap from a coaxial arc-driving coil. The coil is accommodated within and is coaxial to the inner first surface and is included in series with both said surfaces in the arc current path at least during a later part of the movement of the movable contact to the break position for generating a magnetic field that rotates the arc to assist its extinguishment.

15 Claims, 4 Drawing Sheets

ARC INTERRUPTER

BACKGROUND OF THE INVENTION

The invention relates to arc interrupters in which the arc is rotated about an axis to assist in extinguishment of the arc.

There have been a number of proposals to rotate an arc to assist its extinguishment, one early example being disclosed in UK Pat. No. 478890. More recent examples, with arc interrupters which function in an insulating fluid, for example, sulphur hexafluoride ($SF_6$) gas under pressure, are to be found in a paper by Fujiwara K., Ono S. I., entitled "Rotating Arc Driven by Magnetic Flux in $SF_6$ Gas", in UK Pat. application Nos. 2038100A, 2082391A, 2178239A, 2188486A, 2188487A, and 2188488A, and in UK Pat. No. 2119573B. In most of these examples the arc interrupters have a fixed contact and an angularly movable contact, an annular arcing electrode and an arc-driving coil located about the electrode and electrically connected in series with the electrode. In the case of UK Patent Application No. 2082391, the movable contact is axially displaced away from the fixed contact for the break operation and carries an arcing contact that is axially displaceable with it. When the fixed and movable contacts break, the arcing contact establishes an arc between an inner conductor encircling an arc-driving coil mounted on the fixed contact and an outer conductor maintained in conductive contact with the movable contact. In all these examples, the arc, once fully established, extends between the electrode and one of the contacts or a surface electrically continuous therewith and is driven about the central axis of the electrode by the magnetic field generated by the coil.

These known forms of arc interrupter have certain limitations. In the case of GB No. 2082391A, the axial displacement arrangement results in a construction which is considerably larger than would otherwise be the case. Problems can arise with the other examples of arc interrupter as the rating of the interrupter is increased; the electrode can distort or collapse owing to the increased magnetic fields generated by the currents induced in the electrode as a result of the magnetic fields generated by the coil, the respective magnetic fields being in opposition to each other. Also, in arrangements such as that shown in UK Pat. Application No. 2119573A, the mounting and construction of the coil and electrode arrangement is relatively complex.

It is an object of the present invention to provide an arc interrupter in which the aforementioned problems are reduced or obviated.

SUMMARY OF THE INVENTION

According to the present invention, an arc interrupter comprises a fixed contact, a movable contact which is angularly movable between a make position in which said movable contact is in electrical connection with said fixed contact and is included in an openable main current path and a break position in which said movable contact is electrically separated from said fixed contact, an annular arcing electrode and an arc-driving coil, one of said contacts or a surface electrically continuous therewith providing an inner, first arcing surface and said electrode providing an outer second arcing surface, said surfaces, in said break position of said contacts, being coaxial with one another and being separated by an annular gap, said coil being accommodated within and coaxial to said inner first surface and being included in series with said surfaces in an arc current path at least during a later part of movement of said movable contact from said make position to said break position for rotating the arc to assist its extinguishment.

Preferably, said first surface is provided by said fixed contact.

Preferably, said movable contact is normal to a pivot axis which is parallel to the common axis of said surfaces.

The invention includes an electric switch comprising at least one arc interrupter according to the invention.

BRIEF DESCRIPTION OF THE DRAWINGS

The same reference numerals have been used throughout the drawings for like parts.

DESCRIPTION OF THE PREFERRED EMBODIMENTS

Figure 1:
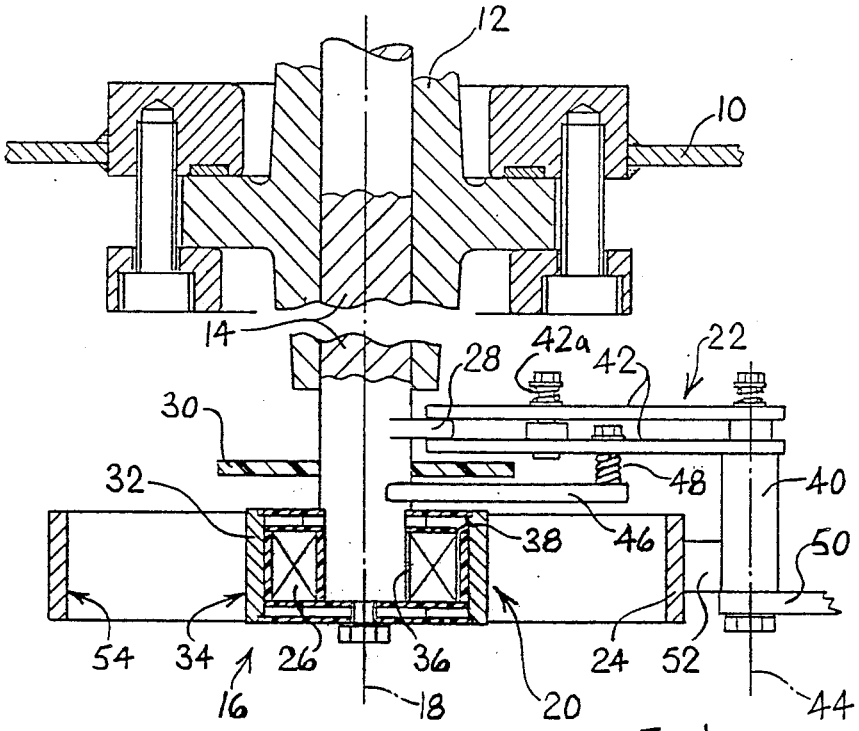
FIG. 1 is a longitudinal section through part of an electric switch incorporating an arc interrupter according to the invention.

Referring to FIG. 1, the switch has a housing 10 of for example metal defining an enclosure which is filled with an insulating medium for example sulphur hexafluoride ($SF_6$) gas under pressure. A bushing 12 insulates a main copper conductor 14 from, and enables it to pass in sealed relationship through, the housing 10. A second main conductor (not shown) is similarly mounted relative to the housing at a location remote from the conductor 14. The two main conductors carry one phase of the current supplied through the switch. It will be understood that there can be identical parallel arrangements to that illustrated for the other phase or phases.

An arc interrupter 16 forms part of an openable main current path between the two main conductors. In this embodiment, the conductors 14 and the interrupter 16 are coaxial with one another on the common axis 18.

The interrupter 16 has a fixed contact arrangement 20; a movable contact assembly 22; an annular electrode 24 and an arc-driving coil 26.

In this embodiment, the fixed contact arrangement 20 is formed directly on the end of the main conductor 14. The arrangement 20 has a contact tongue 28 integrally formed with the conductor 14. Although, for clarity, the tongue 28 is shown extending from the conductor 14, it will be readily apparent that, in other arrangements, the tongue could be formed in a recess in the conductor 14.

A shield 30 of insulating material is mounted on the conductor 14 adjacent the tongue 28.

The arrangement 20 is terminated by a conductive tube 32 mounted on, but being electrically connected via the coil 26 to, the end of the conductor 14. The outer surface of the tube 32 provides an inner, first arcing surface 34 which is coaxial with the common axis 18.

The coil 26 is mounted within the tube 32 coaxially with the surface 34 and is electrically connected at its inner end 36 to the conductor 14 and at its outer end 38 to the tube 32.

The movable contact assembly 22 consists of a pivot block 40 on which is mounted contact blades 42 for angular movement about the pivot axis 44. The blades 42 are resiliently urged together by spring device 42a connected between them and, in a make position, engage the contact tongue 28 of the fixed contact arrangement 20 as is shown in FIG. 1.

One of the blades 42 has an arcing contact member 46 mounted thereon which, in the make position, is in butting engagement with the conductor 14 below the shield 30. The member 46 is urged into contact with the conductor 14 by a torsion spring 48 whereby during an opening operation, the contact member 46 disengages from the conductor 14 after the blades 42 have disengaged therefrom.

The pivot block 40 is electrically connected at 50 to the other main conductor of the phase and to the electrode 24 at 52.

The electrode 24 surrounds the tube 32 of the fixed contact arrangement 20. The inner surface of the electrode 24 provides an outer second arcing surface 54 which is coaxial with the surface 34 of the tube 32 on the common axis 18.

The mechanism for effecting angular movement of the contact blades 42 about the pivot axis 44 is not shown and it may be any suitable mechanism as is well understood in the art. For example it may be a drive shaft, crank and links arrangement of the type described in our UK Pat. No. 2119573B referred to above.

Regarding the operation of the arc interrupter in FIG. 1, it will be seen that the interrupter 16 is shown in the make position. The openable main current path is through the main conductor 14, the contact tongue 28 of the fixed contact arrangement 20, the contact blades 42, the pivot block 40 and the second main conductor. The coil 26 is not in the main current path. Although some current may flow through the arcing contact member 46, it will be only a minor proportion of the main current.

Actuation of the operating mechanism causes angular movement of the contact blades 42 away from the fixed contact arrangement 20. During the initial movement of the blades 42, they disengage from the contact tongue 28 and the current is transferred to the arcing contact member 46. Further movement of the blades 42 causes the member 46 to disengage from the conductor 14 and an arc is struck between the member 46 and the conductor 14. As the end of the member 46 passes across the tube 32, the arc transfers from the conductor 14 to the tube 32 under the influence of the electromagnetic forces generated by the arc.

As the blades 42, and the member 46, move rapidly to their final position, which is outside of the electrode 24, the arc also transfers from the member 46 to the electrode 24.

Upon transference of the arc from the conductor 14 to the tube 32, the coil 26 becomes a part of the arc current path and generates a magnetic field which interacts with the arc to cause it to rotate about the axis 18.

At an appropriate current zero the arc is extinguished.

The interrupter 16 is closed by reverse operation of the operating mechanism.

Figure 2:
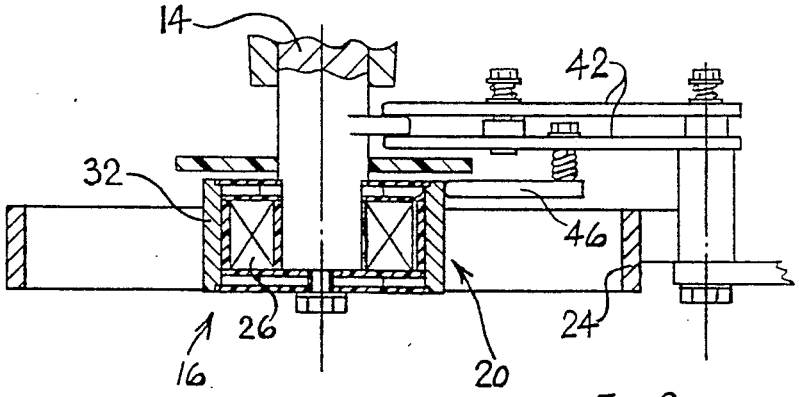
FIGS. 2 to 4 are longitudinal sections similar to the lower part of FIG. 1 of further embodiments of the invention.

The interrupter 16 shown in FIG. 2 is similar to the interrupter 16 shown in FIG. 1. However, in the FIG. 2 embodiment, the arcing contact member 46 is arranged to butt directly on the tube 32 to the fixed contact arrangement 20. This embodiment avoids having to transfer the arc from the conductor 14 to the tube 32. Furthermore, as the coil 26 is in the current path prior to the striking of the arc, the magnetic field generated by the coil 26 is available to drive the arc about the axis 18 as soon as it has been struck.

Figure 3:
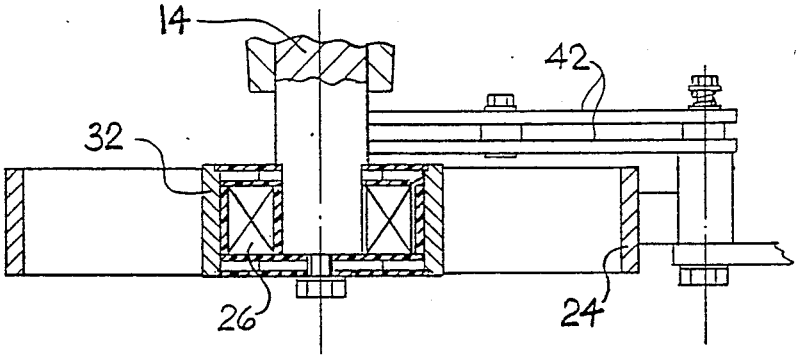
Figure 4:
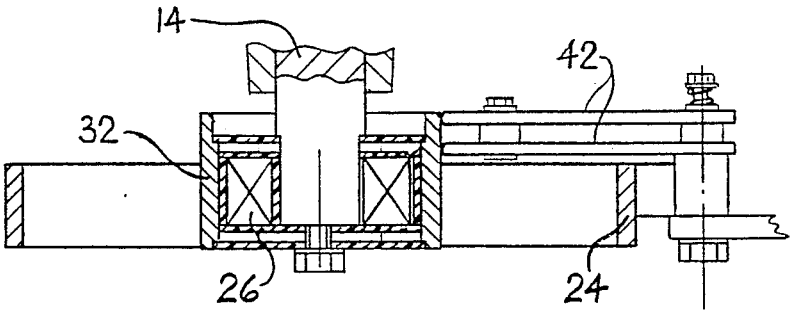

In the embodiments shown in FIGS. 3 and 4, the separate arcing contact member has been dispensed with, the arc being struck, respectively, between the blades 42 and the conductor 14 (FIG. 3) and between the blades 42 and the tube 32 (FIG. 4).

Figure 5:
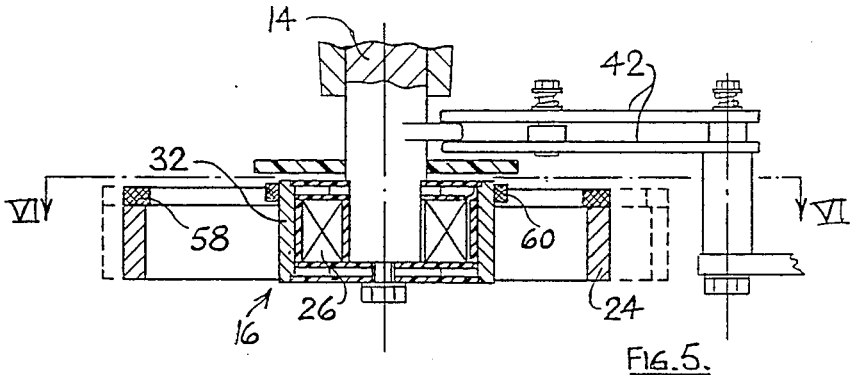
FIGS. 5 and 6 are sectional views of another embodiment of the invention, on lines VI—VI and V—V respectively.
Figure 6:
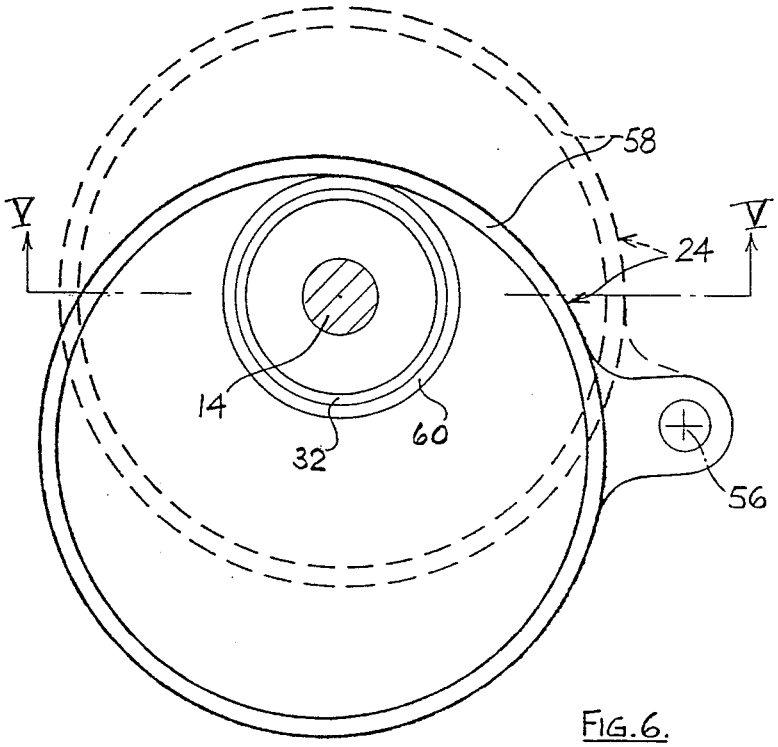

The interrupter 16 shown in FIGS. 5 and 6 has a main current path the same as that shown in FIG. 2. But the annular electrode 24 now also functions as an arcing contact, it being pivotally mounted at 56 for movement towards and away from the tube 32. Thus, upon opening of the interrupter the arc is struck between the annular electrode 24 and the tube 32, as the electrode swings to its open position, shown in ghost outline. Contact between the electrode 24 and the tube 32 is made via rings 58,60 of arc-resistant material mounted, respectively, on the electrode 24 and the tube 32.

In modifications (not shown), the arc-resistant material is only provided locally where the electrode 24 and the tube 32 contact one another or, if only relatively small currents are involved, the arc resistant material is dispensed with. In a further alternative, the electrode 24 and the contact blades 42 are mounted on a common pivot axis.

Mechanism for effecting movement of the electrode 24 about its pivot axis at 56 is not shown and may be of any suitable known pivoting mechanism, for example similar to that used for effecting movement of the contact blades 42. Alternatively, the mechanism for effecting movement of the contact blades 42 may also effect movement of the electrode 24 by way of a lost motion arrangement as will be understood by the person skilled in the art.

Figure 7:
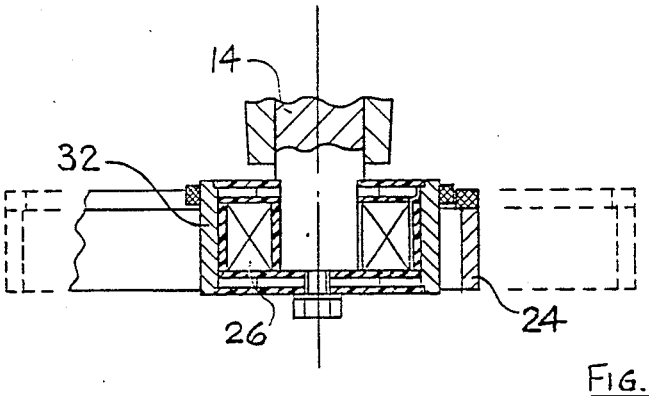
FIGS. 7 and 8 are longitudinal sections similar to the lower part of FIG. 1 of further embodiments of the invention.

The embodiment shown in FIG. 7 uses a similar principle to that shown in FIGS. 5 and 6. However, in this embodiment, the movable contact for the openable main current path (which in other embodiments is represented by the blades 42) is also constituted by the electrode 24. In other words, both the main and the arcing current paths are through the tube 32 and the electrode 24.

Figure 8:
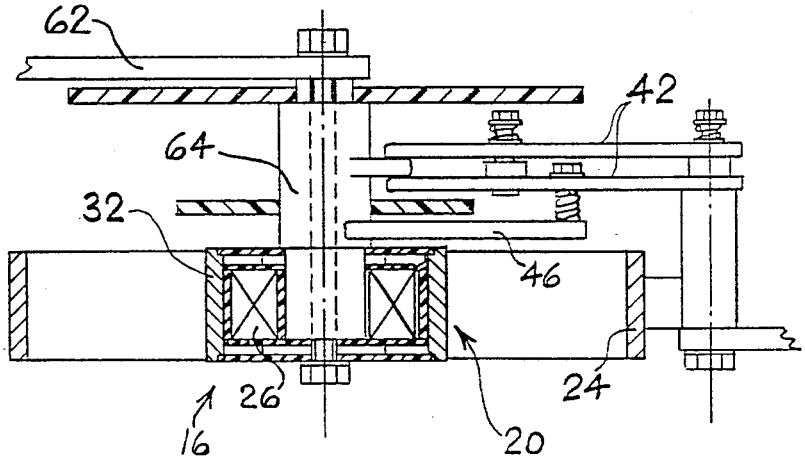

In the embodiment shown in FIG. 8, the interrupter 16 is substantially the same as the interrupter shown in FIG. 1 (and could be the same as the interrupter shown in the other embodiments). However, in this embodiment, the fixed contact arrangement 20 is separate from, and is electrically connected by a conductor 62 to, a first main conductor (equivalent to conductor 14). In this embodiment, the central stem 64 of the arrangement 20 can be partly formed of a conductive ferromagnetic material whereby the magnetic field generated by the coil 26 is enhanced.

Similarly to the embodiment described with reference to FIG. 2, in the embodiments described with reference to FIGS. 4 to 7, no arc transference to the tube 32 has to occur and, because at least some of the current is flowing through the coil 26, a magnetic field is available to drive the arc about the axis 18 as soon as it has been struck. In these embodiments, the coil 26 has to be designed to be capable of continuously carrying current.

Although the coil 26 in interrupters of the form shown will have an equivalent number of ampere/turns to the coil of a prior art construction such as that disclosed by UK Pat. No. No. 2119573 referred to above, the forces generated by the field of the coil is on the tube 32 which is placed in tension and is thus more able to withstand the forces. The location of the coil in the central contact also simplifies the mounting and construction of the annular electrode.

In some of the embodiments described above, the movable contact has been depicted by the blades 42. However, it will be appreciated that other constructions are possible, for example single blades, multiple blades or constructions such as are described in our copending UK Patent Application Publication No. 2188486A. Additionally, other forms of arcing contact can be used.

Other modifications (not shown) are also possible within the scope of the invention. For example, in a reverse of the construction shown in FIG. 7, the electrode 24 is fixed and the central contact arrangement is movable into engagement with it to make the current path, or to a concentric position relative to it when the current path is to be broken. As in FIG. 7, the arcing current path is still through the tube 32 and the electrode 24. Alternatively, the fixed contact may be located externally of the electrode, the movable contact (containing the coil) being angularly movable between the fixed contact and a break position in which it is coaxial with electrode on the common axis.

I claim:

1. An arc interrupter comprising, (i) a pair of external electrical connections and an openable main current path between said connections;

(ii) a fixed contact and a movable contact means for said current path, the movable contact means comprising a main contact means and an arcing contact member;

(iii) pivot mounting means on which said movable contact means is angularly movable between a make position in which said members of the movable contact means are in electrical connection with the fixed contact, thereby to be included in the openable main current path, and a break position in which said members are electrically separated from the fixed contact, (iv) inner and outer annular arcing electrodes providing respective first and second arcing surfaces which, in the break position of said contacts, are coaxial with one another about a central axis;

(v) a fluid-filled annular gap, separating said first and second arcing surfaces in said break position;

(vi) an arc-driving coil disposed within and coaxial to said inner annular arcing electrode;

(vii) the movable contact means being offset away from said electrodes and said annular gap in the direction of the central axis of the electrodes;

(viii) the arcing contact member connection with the fixed contact separating after the separation of the main contact means connection therewith during said movement from the make to the break position, whereby an arc is struck between the fixed contact and the arcing contact member;

(ix) a current path being provided for said arc, at least during a later part of said movement of the movable contact means from the make position to the break position, said current path extending between said first and second arcing surfaces of said arcing electrodes and through said coil in series with said surfaces for rotating the arc to assist its extinguishment; and (x) said fluid filled gap between the arcing surfaces permitting the arc to lengthen both circumferentially and axially relative to said first and second surfaces during the rotation of the arc.

2. An interrupter according to claim 1, in which the pivot mounting means has a pivot axis essentially parallel to a central axis of said annular surfaces and the movable contact is normal to the pivot axis.

3. An interrupter according to claim 1, in which the movable contact comprises a combined main current-carrying and arcing contact.

4. An interrupter according to claim 1, in which the movable contact comprises respective main contact and arcing contact members.

5. An interrupter according to claim 4, in which, in said make position, the main contact member makes electrical connection with the fixed contact adjacent to the first annular surface and the arcing contact member makes electrical connection with the fixed contact through the first annular surface whereby the coil is connected in parallel with the main current path.

6. An interrupter according to claim 1, in which, in said make position, engagement between the fixed and movable contacts is made adjacent to the first annular surface, in which state the coil is not included in the main current path.

7. An interrupter according to claim 1, in which, in said make position, engagement between the fixed and movable contacts is made at the first annular surface, in which state the coil is included in the main current path.

8. An interrupter according to claim 1, in which the movable contact provides the arcing electrode.

9. An interrupter according to claim 8, in which the movable contact comprises respective main contact and arcing contact members and the electrode provides the arcing contact member.

10. An arc interrupter according to claim 1 wherein said arcing contact member provides a shunt for the arc-driving coil during a first part of said movement to the break position, the arc being transferred from the fixed contact to the first arcing surface after said first part of said movement whereby to establish said current path.

11. An electrical switch having a housing containing a fluid insulating medium and conductor means which form an openable main current path within the housing, the switch including at least one arc interrupter comprising:

(i) a fixed contact and a movable contact means for said current path, the movable contact means comprising a main contact means and an arcing contact member;

(ii) pivot mounting means on which said movable contact means is angularly movable between a make position in which said members of the movable contact means are in electrical connection with the fixed contact, thereby to be included in the openable main current path, and a break position in which said members are electrically separated from the fixed contact, (iii) inner and outer annular arcing electrodes providing respective first and second arcing surfaces which, in the break position of said contacts, are coaxial with one another about a central axis;

(iv) an annular gap extending the depth of said electrodes in the direction of said central axis separating said first and second arcing surfaces and said fluid insulating medium occupying said annular gap;

(v) the movable contact means being offset away from said electrodes and annular gap in the direction of the central axis of the electrodes;

(vi) the arcing contact member connection with the fixed contact separating after the separation of the main contact means connection therewith during said movement from the make to the break position, whereby an arc is struck between the fixed contact and the arcing contact member;

(vii) an arc-driving coil disposed within and coaxial to said inner annular arcing electrode surface;

(viii) a current path being provided for said arc, at least during a later part of said movement of the movable contact means from the make position to the break position, said current path extending between said first and second arcing surfaces of said arcing electrodes and through said coil in series with said surfaces for rotating the arc to assist its extinguishment; and (ix) said gap between the arcing surfaces permitting the arc to lengthen both circumferentially and axially relative to said first and second surfaces during the rotation of the arc.

12. An arc interrupter comprising, (i) a pair of external electrical connections and an openable main current path between said connections;

(ii) a fixed contact and a movable contact means for said current path, the moveable contact means comprising a main contact means and an arcing contact member;

(iii) mounting means on which said movable contact means is movable between a make position in which said members of the movable contact means are in electrical connection with the fixed contact, thereby to be included in the openable main current path, and a break position in which said members are electrically separated from the fixed contact, (iv) inner and outer annular arcing electrodes providing respective first and second arcing surfaces which, in the break position of said contacts, are coaxial with one another about a central axis;

(v) a fluid-filled annular gap, separating said first and second arcing surfaces in said break position;

(vi) an arc-driving coil disposed within and coaxial to said inner annular arcing electrode;

(vii) the movable contact means being offset away from said electrodes and said annular gap in the direction of the central axis of the electrodes;

(viii) the arcing contact member connection with the fixed contact separating after the separation of the main contact means connection therewith during said movement from the make to the break position, whereby an arc is struck between the fixed contact and the arcing contact member;

(ix) a current path being provided for said arc, at least during a later part of said movement of the moveable contact means from the make position to the break position, said current path extending between said first and second arcing surfaces of said arcing electrodes and through said coil in series with said surfaces for rotating the arc to assist its extinguishment; and (x) said fluid filled gap between the arcing surfaces permitting the arc to lengthen both circumferentially and axially relative to said first and second surfaces during the rotation of the arc.

13. An arc interrupter comprising, (i) a pair of external electrical connections and an openable main current path between said connections;

(ii) a fixed contact and a movable contact means for said current path, the movable contact means comprising a main contact means and an arcing contact member;

(iii) mounting means on which said movable contact means is moveable between a make position in which said members of the movable contact means are in electrical connection with the fixed contact, thereby to be included in the openable main current path, an initial break position in which both said main contact means and said arcing contact member are in electrical connection with the fixed contact and a break position in which said members are electrically separated from the fixed contact, (iv) inner and outer annular arcing electrodes providing respective first and second arcing surfaces which, in the break position of said contact, are coaxial with one another about a central axis;

(v) a fluid-filled annular gap, separating said first and second arcing surfaces in said break position;

(vi) an arc-driving coil disposed within and coaxial to said inner annular arcing electrode;

(vii) the movable contact means being offset away from said electrodes and said annular gap in the direction of the central axis of the electrodes;

(viii) the arcing contact member connection with the fixed contact separating after the separation of the main contact means connection therewith during said movement from the make to the break position, whereby an arc is struck between the fixed contact and the arcing contact member;

(ix) a current path being provided for said arc, at least during a later break position when the movement of the movable contact means from the make position to the break position is completed, said current path extending between said first and second arcing surfaces of said arcing electrodes and through said coil in series with said surfaces for rotating the arc to assist its extinguishment; and (x) said fluid filled gap between the arcing surfaces permitting the arc to lengthen both circumferentially and axially relative to said first and second surfaces during the rotation of the arc.

14. An arc interrupter according to claim 13 wherein said main contact means is connected to said arcing contact member.

15. An arc interrupter according to claim 14 wherein said main contact means is pivotably connected at its middle portion to said arcing contact member.

* * * * *